US005284273A

United States Patent [19]

Schreiber

[11] Patent Number: 5,284,273

[45] Date of Patent: Feb. 8, 1994

[54] DISPENSING CLOSURE HAVING MULTIPLE FLUID SEALS, AND AN INTERIOR CAP WALL WITH NOTCH AND EXTERIOR CAP WALL WITH RECESSED OPENING DEFINING A DISPENSING CANAL

[76] Inventor: Alexander R. Schreiber, 159 Windsong St., Thousand Oaks, Calif. 91360

[21] Appl. No.: 58,389

[22] Filed: May 10, 1993

[51] Int. Cl.[5] ..... B65D 47/00; B67D 5/06

[52] U.S. Cl. ..... 222/39; 222/48; 222/519; 222/553

[58] Field of Search ..... 222/23, 39, 41, 47, 222/48, 519, 520, 521, 549, 551, 553

[56] References Cited

U.S. PATENT DOCUMENTS

| | | | |
|---|---|---|---|
| 2,112,125 | 3/1938 | von Bultzingslowen | 222/519 X |
| 2,860,821 | 11/1958 | Hartung et al. | 222/519 |
| 3,006,514 | 10/1961 | Collins | 222/553 |
| 3,095,128 | 6/1963 | Wonso | 222/519 X |
| 3,258,179 | 6/1966 | Cherba | 222/553 X |
| 3,261,513 | 7/1966 | Moran | 222/519 |
| 3,261,515 | 7/1966 | Luedtke | 222/520 |
| 3,406,879 | 10/1968 | Stull . | |
| 3,439,843 | 4/1969 | Corsette | 222/520 X |
| 3,471,066 | 10/1969 | Micallef | 222/519 |
| 3,606,105 | 9/1971 | Santore | 222/520 |
| 4,172,541 | 10/1979 | Harris et al. | 222/519 |
| 4,961,515 | 10/1990 | Schreiber | 222/553 X |
| 4,964,548 | 10/1990 | Kenyon, Jr. | 222/521 |
| 5,111,967 | 5/1992 | Schreiber | 222/519 X |
| 5,158,206 | 10/1992 | Kobayashi et al. | 222/39 |
| 5,199,605 | 4/1993 | Schneider | 222/521 X |

FOREIGN PATENT DOCUMENTS

3514132A1 10/1986 Fed. Rep. of Germany .

*Primary Examiner*—Kevin P. Shaver

[57] ABSTRACT

A rotatable cap and modified container neck. Depending from a top panel of the cap is an annular exterior wall and a smaller concentrically positioned interior wall with a space between the two walls sized to receive an upper and thinned portion of the container neck with a tight fit providing a fluid seal. The interior wall of the cap contains a dispensing notch which is aligned straight across with a dispensing opening through the exterior wall. With rotation, the cap raises and lowers on threads relative to the container. When the cap is lowered, the container neck blocks the dispensing canal between the notch in the interior wall and the dispensing opening in the exterior wall of the cap. The top rim of the container neck abuts the interior cap ceiling between the two walls to form a seal. When the cap is raised, the container neck is in part below the notch in the interior wall and the dispensing opening, and thus the dispensing canal is open. The cap and container neck include stop blocks to prevent removal of the cap, and further include cooperative structures which provide an audible click and vibration which can be felt just prior to the dispensing opening reaching either a full open or full closed position. The dispensing opening is positioned at the approximate intersection of the outer wall and cap top in a depression structured for easy cleaning of the dispensing opening.

2 Claims, 7 Drawing Sheets

DISPENSING CLOSURE HAVING MULTIPLE FLUID SEALS, AND AN INTERIOR CAP WALL WITH NOTCH AND EXTERIOR CAP WALL WITH RECESSED OPENING DEFINING A DISPENSING CANAL

BACKGROUND OF THE INVENTION

1. Field of the Invention

This invention relates to dispensing closures for bottles and tubes, and more precisely to a twist open, twist close dispensing cap and cooperatively structured neck on a container of the type commonly used to contain and dispense skin or hair care products and the like.

2. Description of the Prior Art

A wide variety of dispensing closures have been introduced over the years for dispensing fluid products from containers such as bottles and squeeze tubes. A feature common to many modern closures is that a cap is permanently yet movably retained onto a container neck and a dispensing aperture of the cap is opened by a rotating or pulling motion. A problem common to some of the dispensing closures appears to be a weakness in the sealing structure, especially evident during shipping when the containers are exposed to a significant change in altitude and thus in air pressure or temperature. Another common problem is the convenience of using the container and closure, since with some caps there is some question as to when the cap is fully open or closed. Yet another problem exists in maintaining a relatively sanitary system which does not clog or promote the excessive growth of bacteria by way of leaving product exposed to the air or in the dispensing canal where it can culture bacteria or dry.

Another problem is that some prior art closures require multiple separate pieces beyond just the container, neck, and one piece cap. The additional pieces may be center plug pieces inserted in the neck, or movable hinged lids attached as separate items to the cap body. These additional pieces cost time to assemble and money to manufacture in the form of additional materials and tooling, and these costs are of course past onto the consumer.

Although my invention is necessarily somewhat similar to the prior art container closures, I feel I have overcome many of the prior art short comings by providing a unique combination of structures in a single closure for a container such as a plastic bottle or squeeze tube.

SUMMARY OF THE INVENTION

The present invention is an improved twist open, twist close plastic dispensing cap for use with a cooperatively structured neck attached to a container such as a bottle or squeeze tube. My container closure is primarily structured for, but not limited to dispensing fluids such as hair and skin care products, but would also function with fluid powders. My invention provides improved fluid sealing which in part includes a tight frictional fit between the neck of the container and annular interior and exterior walls of the cap. There are also additional seals, one including the abutment of the top rim of the container neck against the interior ceiling of the cap, and abutment of a lower beveled edge of the interior wall of the cap against a bevel on the interior of the container neck. There may also be a V-shaped ring located on the ceiling of the cap which is compressed by the top of the neck when the cap is closed, thus forming a tight seal. These features provide an exceptional sealing arrangement which prevents leakage of the container contents, even during shipping when variations in temperature and air pressure are a problem.

A corner dispensing aperture of the present invention, located at the approximate intersection of the outer cap wall and cap top, has been found by some to be more convenient for dispensing the container contents, allowing the container to be held at an angle rather than straight upside down, and additionally helping the user to retrieve the last few drops of product when the container is nearly empty. The top exterior of the cap is also structured to support the container upside down on a level surface to allow the contents to flow towards the cap where the last of the container contents can be collected over a period of time and easily removed. When the container is upside down on a level surface, a sloped interior ceiling of the cap additionally helps provide for retrieval of the last few drops of product by concentrating the fluid product adjacent the dispensing canal of the cap.

The dispensing aperture is positioned centrally within a concave shaped depression on the exterior of the cap sized to allow the user to easily clean the orifice with a wipe of a finger or cloth, and this helps to keep the opening clean and unclogged. An unusually thin upper portion of the container neck helps avoid the build up of product on the top of the neck which helps eliminate the growth of bacteria further maintaining a relatively sanitary state.

The twist open/close feature of my closure involves raising and lowering the cap on steeply pitched threads, wherein clockwise or counter clockwise rotation of the cap opens or closes the dispensing canal of the closure. Only a quarter turn of the cap is required to open or close the dispensing canal. Stop blocks positioned on both the cap and container neck prevent the cap from being inadvertently twisted off the container neck during opening of the dispensing canal. The stop blocks do not abut for closure of the cap, instead closure is complete when the multiple seals engage, generally simultaneously with one another, making it difficult to further rotate the cap. An audible click which may also provide a vibration which can be sensed by the fingers is provided by pins on the cap riding over stop blocks on the container neck at a proper time to indicate to the user that the closed position has been accomplished. The user will then not tend to force the cap tighter which may damage or override the threads. Audible clicks and also preferably vibrations are also provided at the proper time to alert the user when the cap is in the full open position.

OBJECTS OF THE INVENTION

It is an object of my invention to provide a dispensing closure for a container with improved sealing and more convenient dispensing.

Another object of the invention is to provide the above in a dispensing closure having structure which clearly indicates to the user both an open and a closed dispensing canal.

An even further object of the invention is to provide the above in a dispensing closure which can be stored upside down, supporting the container in a stable position for collecting and dispensing of the last of the container contents.

A still further object of the invention is to provide the above in a dispensing closure which is resistant to clogging.

A further object of the invention is to provide the above in a dispensing closure which is structured to help retard or at least not promote the growth of bacteria which sometimes occurs with certain products when exposed to air.

A still further object of the invention is to provide the above in a dispensing closure which is inexpensive to manufacture, and thus may provide the consumer with an inexpensive and highly effective closure for a container.

Many other objects and advantages of my invention will become apparent with a reading of the remaining specification, study of the accompanying drawings, and from the claims.

DESCRIPTION OF THE PREFERRED EMBODIMENT

Figure 1:
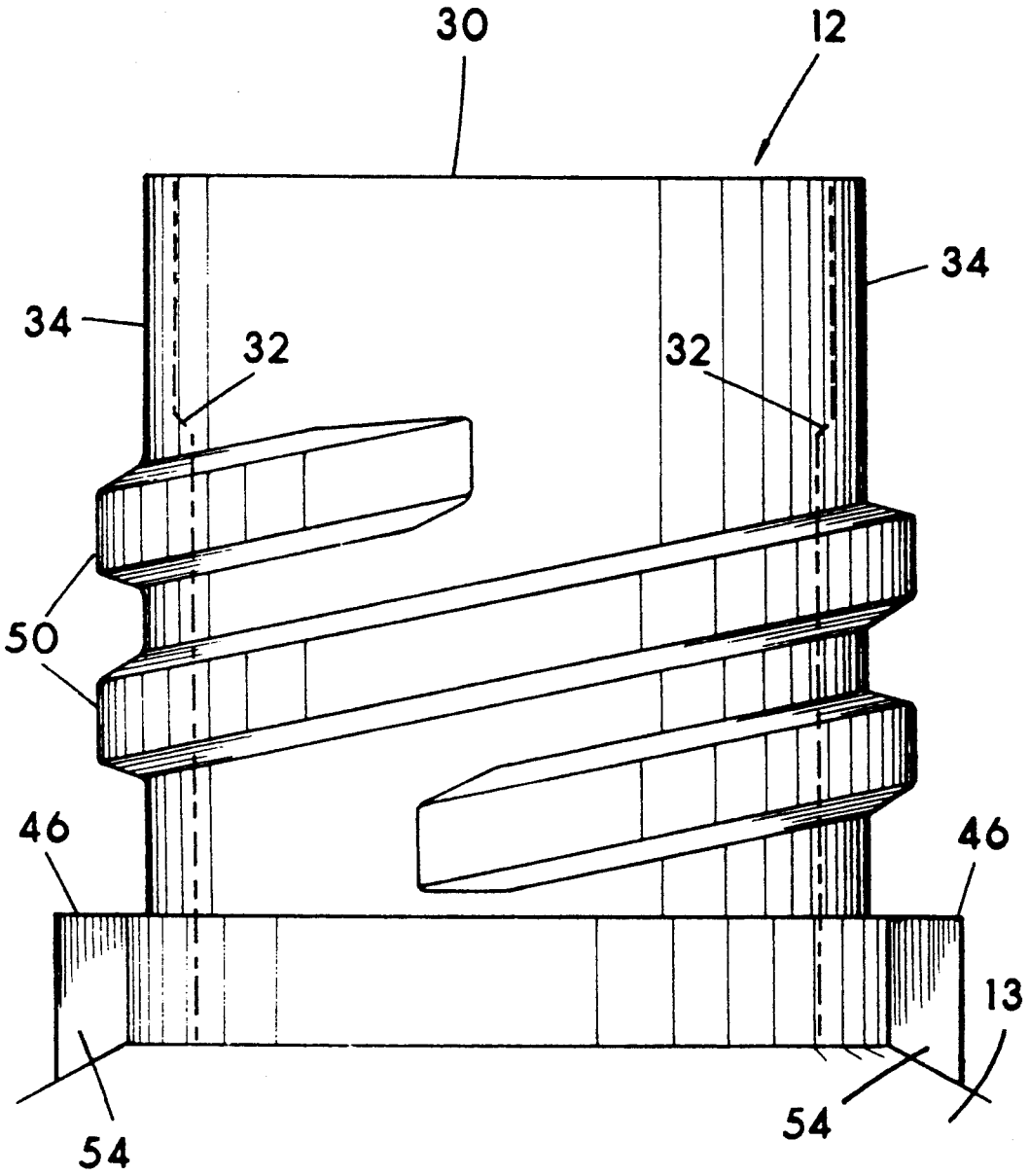
FIG. 1 is an enlarged side view of the neck of the container with the dotted outline showing the beveled structure of the interior of the neck where the wall thickness is substantially reduced toward the upper terminal end or rim of the neck. A wall thickness transitional angled plane is indicated by the dotted line, and this angled plane is shown similar to the angled plane or slope at the bottom terminal end of the interior wall of the cap shown in FIG. 2.
Figure 2:
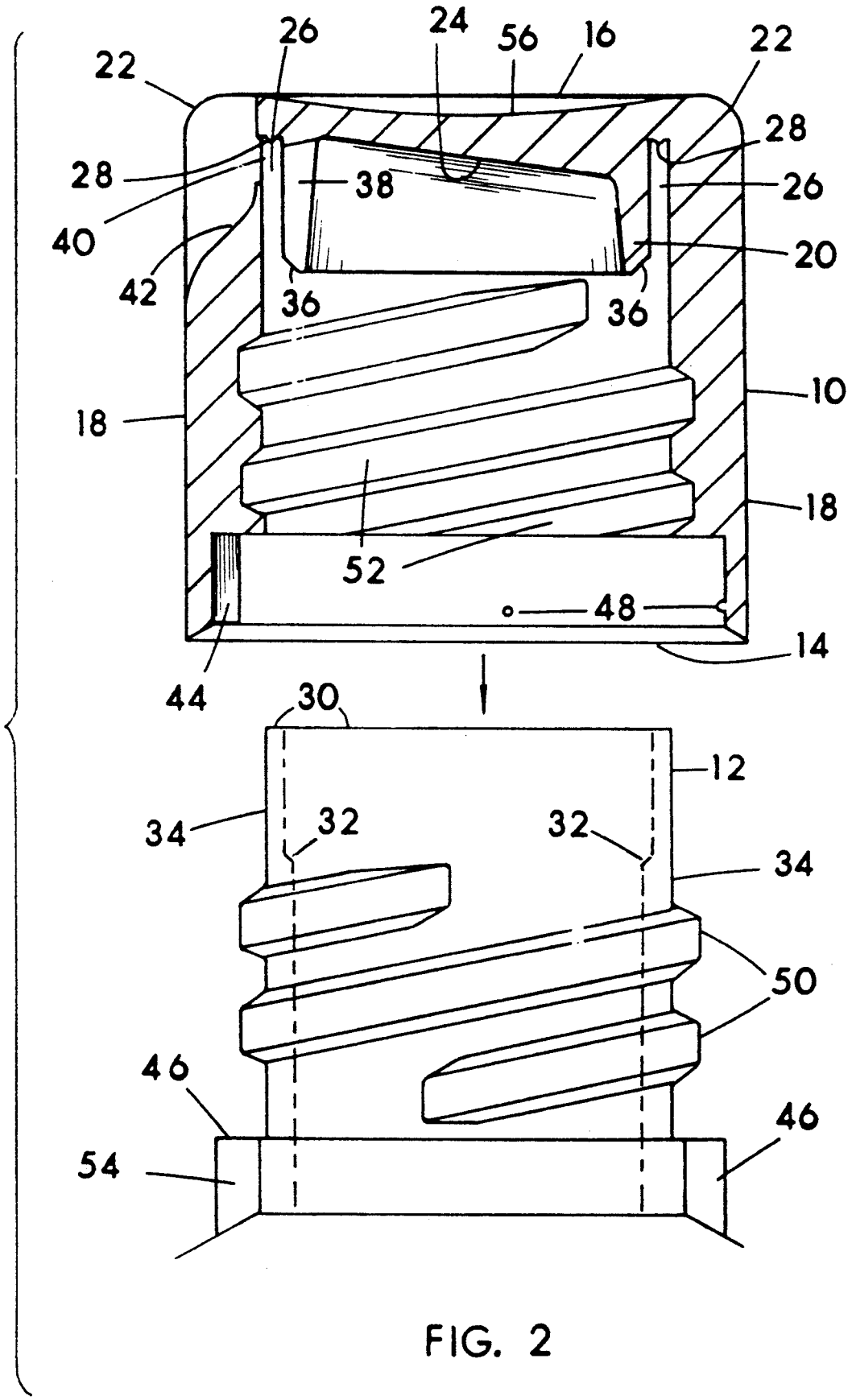
FIG. 2 is a cross sectional side view of the cap positioned above the upper portion of the container neck (not cross-sectioned). A dispensing notch in the annular interior wall of the cap is shown, along with the small V-shaped ring on the interior cap ceiling in the space between the interior and exterior walls.
Figure 3:
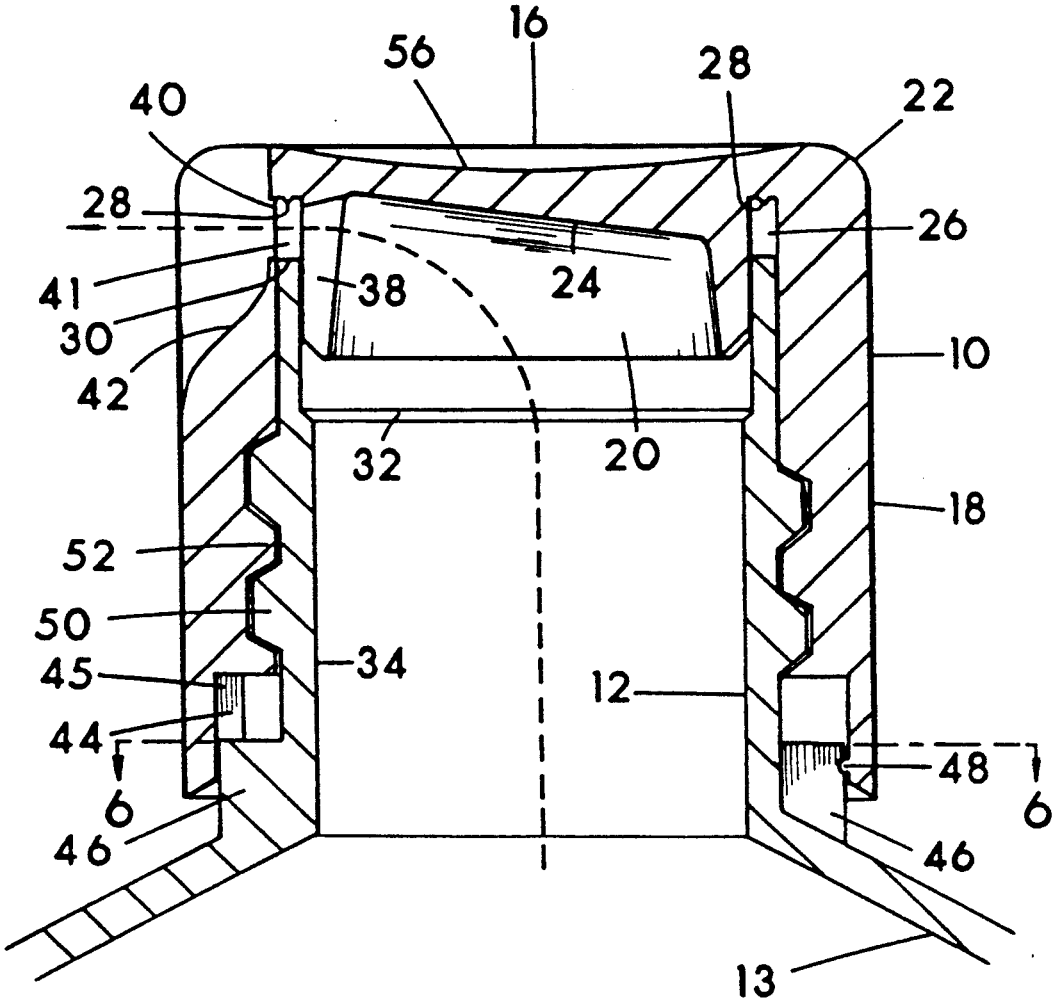
FIG. 3 is a cross sectional side view of the cap attached to the container neck with the dispensing canal in the open position. The stop blocks of the closure are abutted against one another as depicted in FIG. 6. The dotted line represents the direction of the fluid flow through the open dispensing canal defined by the notch in the interior wall being aligned with the dispensing aperture through the exterior wall, and with both the notch in the interior wall and the dispensing aperture of the exterior wall being raised above the top rim of the container neck. The thinned upper portion of the container neck is shown sandwiched tightly yet movably between the interior and exterior walls of the cap below the dispensing aperture in the exterior wall to provide a maintained fluid seal in this area even with the dispensing canal in the full open position. The interior wall of the cap is shown remaining within the container neck.
Figure 4:
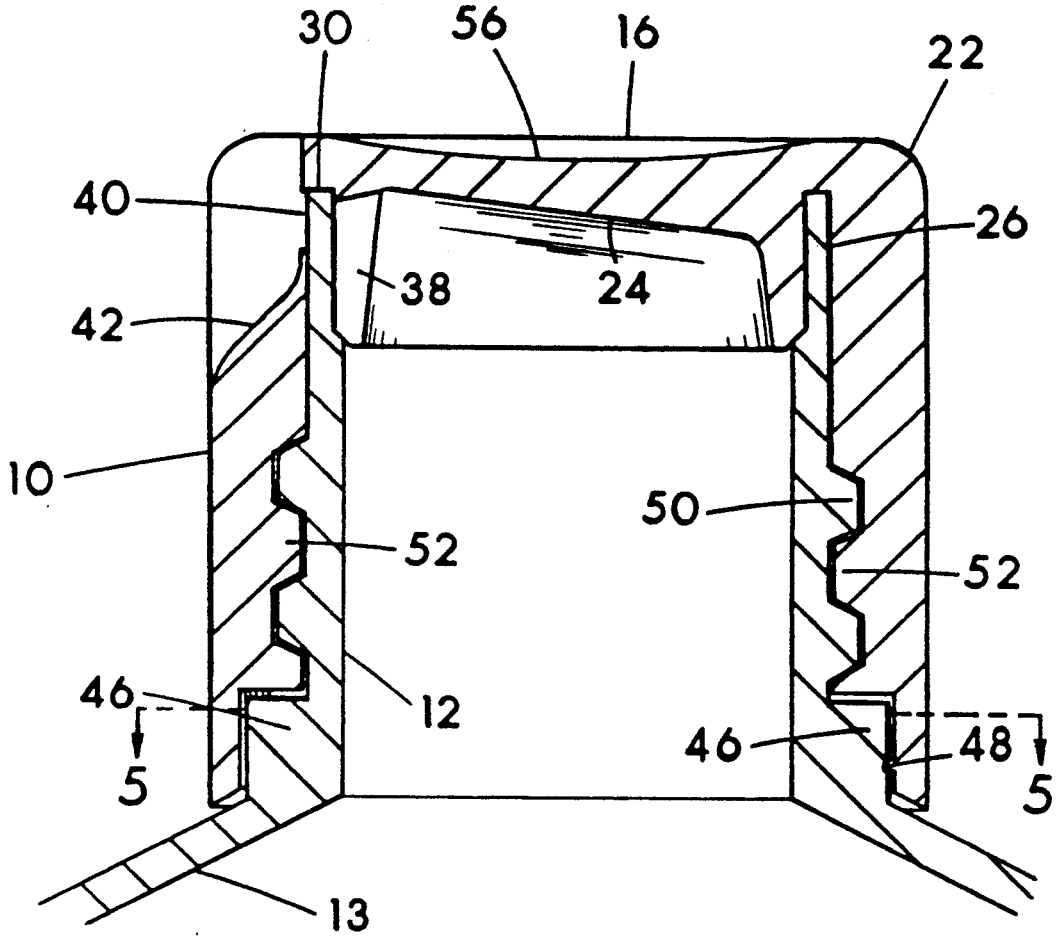
FIG. 4 is an enlarged cross sectional side view of the cap attached to the container neck with the dispensing canal blocked by the position of the thinned upper portion of the container neck, and thus the closure is in the closed position. The neck has been rotated relative to the cap which has in effect brought the cap downward relative to the container. The annular top rim of the container neck is shown abutting the cap ceiling and blocking the flow path over the neck rim between the dispensing aperture and notch of the cap. The angled planes of the interior wall of the container neck and at the bottom terminal end of the interior wall of the cap are shown abutting one another to form an additional seal.
Figure 5:
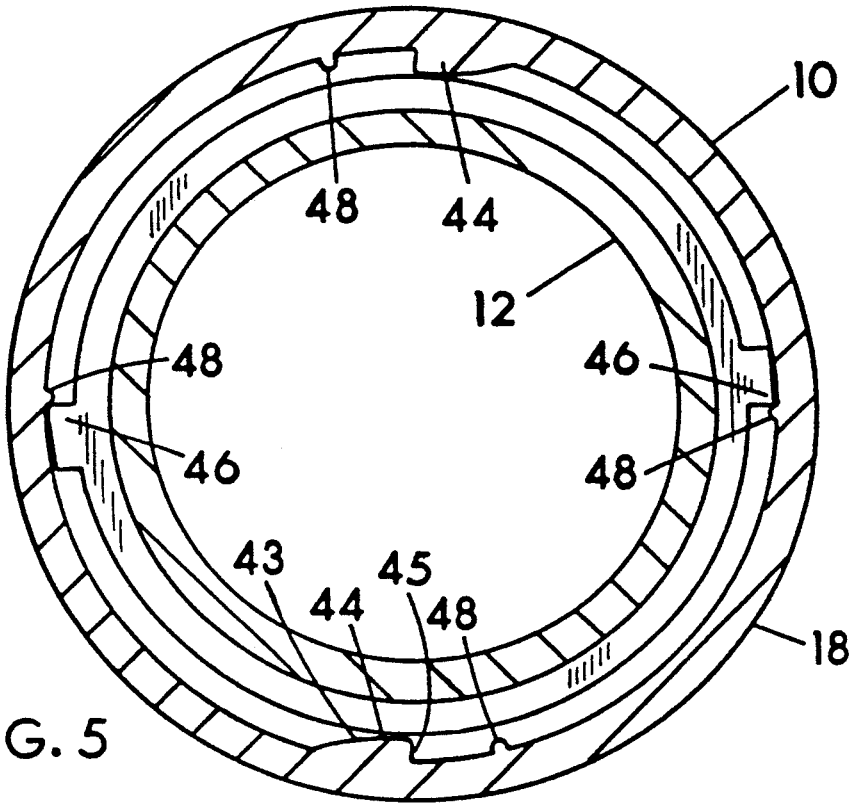
FIG. 5 is an enlarged cross sectional top plan view, in the area of the stop blocks of the cap assembled onto the neck. This view depicts the location of the stop blocks in relation to one another and of the "click" indicators with the cap in the closed position as in FIG. 4.
Figure 6:
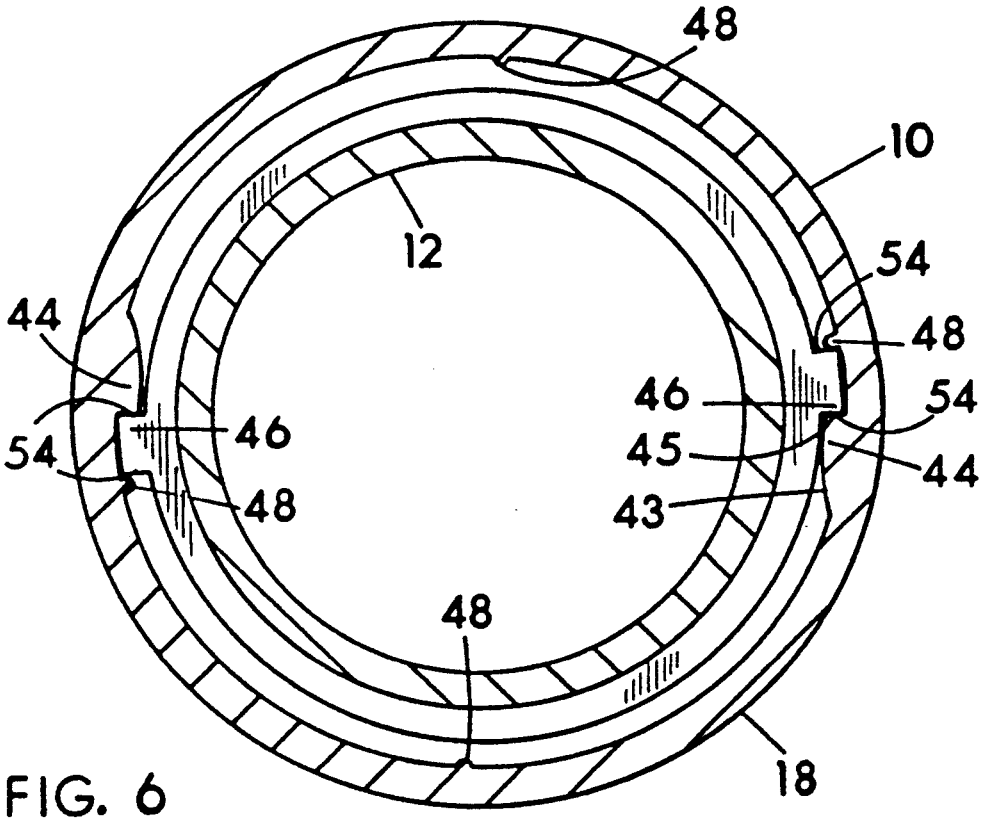
FIG. 6 is a cross sectional top plan view of the assembled cap and container neck with the stop blocks shown abutting to limit rotation and rising of the cap and to indicate an open dispensing canal as in FIG. 3. The small pins (click indicators) are shown on the cap relative to the stop blocks of the container neck.
Figure 7:
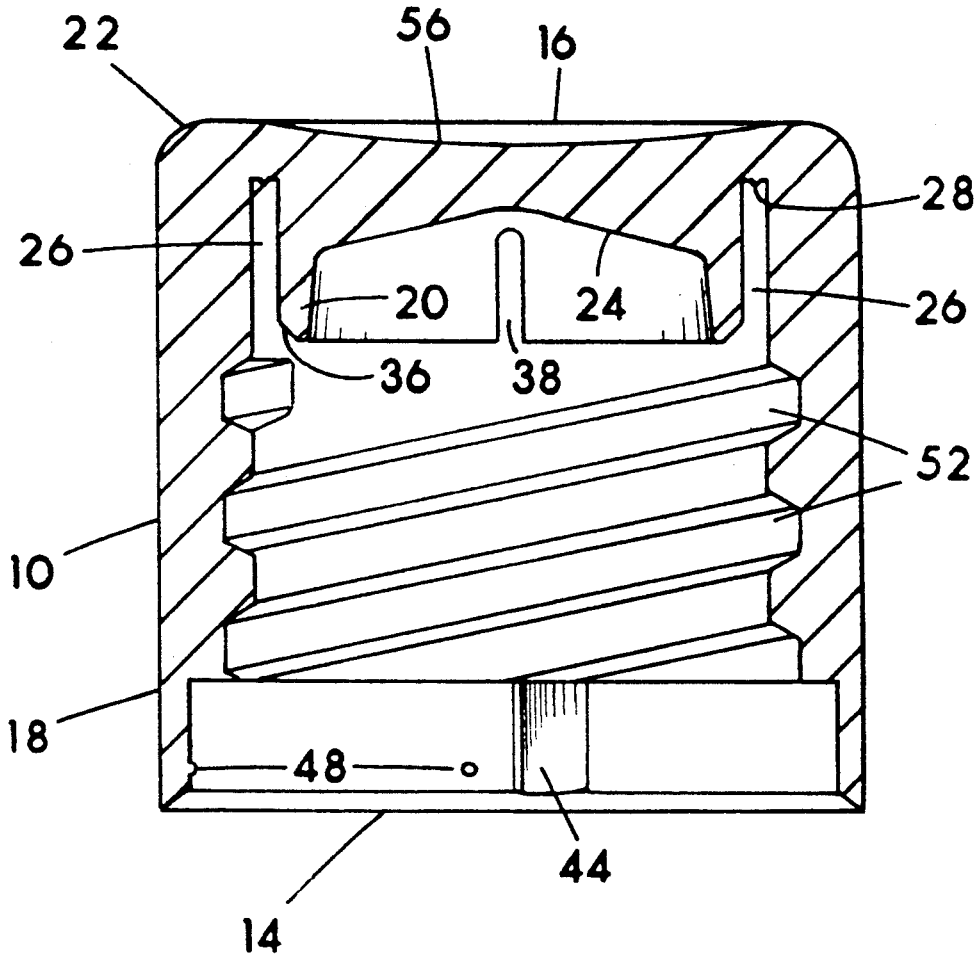
FIG. 7 is a cross sectional side view of the cap taken at a 90 degree angle to that of FIG. 2, showing the dispensing notch through the annular interior wall.
Figure 8:
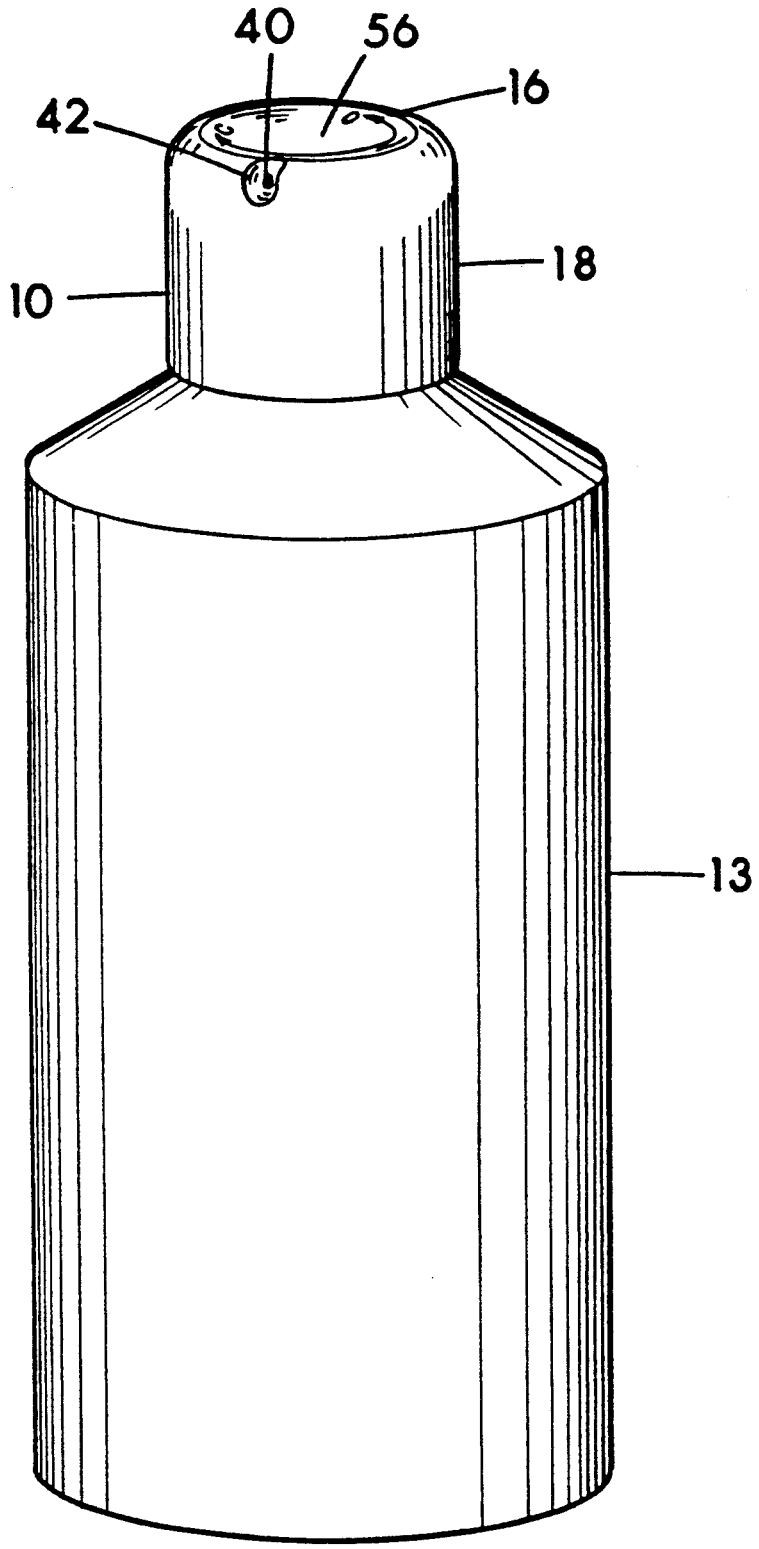
FIG. 8 is a perspective view of the cap affixed to a container. The dispensing aperture is shown located within the concave area on the exterior of the cap at the approximate intersection of the exterior or outer cap wall and cap top panel.

Referring now to the drawings for a further detailed description of a preferred structural embodiment of the present invention. Of course some of the features shown and described are optional within the scope of the invention as this is a description of the preferred embodiment, and the true scope of my invention will be given in the claims. The closure comprises both cap 10 and a modified container neck 12 attached to a container such as bottle 13 for example. Cap 10 is ideally suited for injection molding using a thermoplastic material such as polyethylene or the like. The plastic should have a degree of flexibility and resiliency to allow the initial installation of cap 10 onto container neck 12, and to provide for the "clicks" which indicate a full open or closed dispensing canal. Cap 10 is a cylindrical member having an open bottom end 14 and an oppositely disposed closed top end defined by top panel 16. Cap 10 has an annular exterior wall 18 and a smaller diameter annular interior wall 20 placed concentric with and in spaced relationship to wall 18, with both walls 18 and 20 attached to and extending in the same direction perpendicularly from top panel 16. Interior wall 20 does not extend downward toward the open bottom end of the cap as far as exterior wall 18 as may be ascertained from the drawings. Threads 52 are applied to the interior surface of exterior wall 18, extending from slightly above stop blocks 44 of the cap upward to terminate at about the same level as the bottom terminal end of interior wall 20. Both walls 18 and 20 depend from the interior underside or ceiling 24 of top panel 16 of cap 10. The ceiling 24 within interior wall 20 may be sloped or angled towards one side, with the central portion containing a slightly recessed ridge, as shown in FIG. 7, so as to direct fluid toward the dispensing canal 41 when product is being dispensed, or when the bottle 13 is resting upside down on cap 10. Due to the differences in diameter between walls 18 and 20, a narrow space is maintained between the two. This narrow space is designated in the drawings as container neck housing 26, sized for receiving the substantially thinned annular upper portion of container neck 12. The section of ceiling 24 between walls 18 and 20 abuts with the top rim 30 of container neck 12 to form a leak proof seal when the closure is closed. This section of ceiling 24 may also affixed with a small extending and somewhat flexible annular V-shaped seal ring 28 which abuts against top rim 30 of container neck 12 to form sealing structure. An additional sealing structure is provided by container neck seal 32 which is comprised of a small annular beveled ledge along the interior surface of container neck side wall 34 of neck 12, at the location where the neck wall thickness is reduced in the interior upward above the terminal upper end of the threads 50 of the neck 12. Beveled container neck seal 32 abuts with a mating beveled edge located on the lower or bottom terminal edge of interior wall 20, which is referred to as beveled cap seal 36. Seals 32 and 36 are cooperatively structured to abut tightly together when cap 10 is in the closed position, providing a fluid tight seal. Interior wall 20 of cap 10 has an elongated vertical dispensing notch 38, best shown in FIG. 7, the top portion of which is horizontally aligned with a circular dispensing aperture 40 extending through exterior wall 18 of cap 10. Dispensing notch 38 could possibly be an annular aperture, but for manufacturing purposes the elongated notch opening through the bottom terminal end of wall 20 is preferred since less expensive plastic injection molding tooling may be used. Dispensing aperture 40 terminates on the exterior of cap 10 in a concave depression 42. Concave depression 42 extends through a portion of exterior wall 18 and a portion of a slightly rounded edge 22 in the exterior surface of cap 10 at the approximate juncture of top panel 16 and exterior wall 18. Depression 42 is in part exposed on top 16 of the cap as may be best ascertained from FIG. 4, as this will allow depression 42 and dispensing aperture 40 to be molded in an injection tool cavity which does not require an expensive retractable core pin on the exterior of the cap cavity to form depression 42 since with careful placement of the depression 42 and aperture 40, the cap can be ejected straight out of the mold cavity as those skilled in injection mold tooling will readily appreciate, and this will further assist in rendering cap 10 inexpensive to manufacture. Dispensing aperture 40 is essentially formed at the deepest center location of depression 42 where the plastic has thinned sufficiently in the concavity to define aperture 40 through exterior wall 18. Dispensing aperture 40 and dispensing notch 38 form, in combination, the major portion of dispensing canal 41 which is used to dispense the contents of bottle 13.

The lower edge of the interior surface of exterior wall 18 of cap 10, adjacent the open bottom end of the cap, is affixed with two small stop blocks 44 having triangular wedge shaped backs 43 and flat fronts 45, and placed generally below the bottom terminal end of threads 52 adjacent the bottom open end of the cap 10. Stop blocks 44 are placed equidistance from one another, and although one stop block 44 and one stop block 46 on the neck 12 could be made to function with this closure, two sets are preferred as they also provide some lateral stability to the cap 10 on the neck 12 by applying equal pressure to two oppositely disposed side of the cap 10. Attached by integral molding on the lower edge of the interior surface of exterior wall 18 of cap 10, adjacent the open bottom end of the cap and adjacent the flat front 45 of each stop block 44 are extending pins 48. One pin 48 in front of each block 44, and placed in distance in front of flat front 45 a distance just slightly wider than the width across rectangular stop blocks 46 of neck 12. Also attached by integral molding on the lower edge of the interior surface of exterior wall 18 of cap 10, adjacent the open bottom end of the cap is a second set of pins 48, placed equidistance from one another and approximately ninety degrees from the first pins 48 adjacent stop block 44. This second set of pins 48 are used to make a "click" when the closure reaches a full closed position as will be appreciated with continued reading.

The elongated hollow container neck 12 may be positioned on the top surface of any size or shape of container, squeeze tube or bottle 13. The interior of neck 12 has two diameters defined by the wall thickness being greater near the bottle and in the area supporting threads 50, and then tapering inward at seal 32 at about three quarters of the Way upward neck 12 from bottle 13 into a substantially thin upper portion of the neck. The thinned upper portion is sized for a tight frictional fit within container neck housing 26 of cap 10. The thicker lower portion of neck 12 renders the neck sufficiently strong, and the upper thin portion being only about 0.035 inches thick at top rim 30 of the bottle neck 12 provides a very small surface area on which product may rest, and this provides for improved sealing and renders the closure less likely to clog or promote the growth of bacterial. It will be recognized by those skilled in the art that container neck 12 is well suited to be molded at the same time directly onto a plastic container during blow molding of the bottle 13. The outer surface of container neck side wall 34, which is essentially one diameter, is affixed with exterior threads 50, which are structured to rotatably engage interior threads 52 of cap 10. Threads 50 and 52 allow clockwise and counterclockwise rotation of cap 10 horizontally relative to bottle 13 and provides a connection that generally eliminates vertical play of cap 10 on bottle 13. The flat fronts 45 of stop blocks 44 are structured and positioned to cooperatively engage two oppositely disposed square or rectangular shaped stop blocks 46, attached to the exterior bottom edge of container neck 12 at the approximate juncture of neck 12 and bottle 13, and space equidistant from one another.

When cap 10 is fully assembled onto container neck 12, stop blocks 44 and 46 are positioned relative to one another and structured to abut at a certain location thus limiting rotation of cap 10. When stop blocks 44 and 46 abut, dispensing canal 41 is in the full open position. To further indicate to the user when dispensing canal 41 is in or near the open position, as well as closed, an audible click is provided. This click, which can also be felt, occurs when small domed shaped pins 48 which are located on the interior surface of exterior wall 18 of cap 10 ride over blocks 46. The flexibility and resiliency of the material of which cap 10 is manufactured allows pins 48 to snap over stop blocks 46, creating the audible click and vibration in the process. One pin 48 is located adjacent to the flat front of each stop block 44 where it emits a click and vibration just prior to or simultaneously with the engagement of the stop blocks 44 and 46. A second set of pins 48 is located on cap 10, equidistance from one another and approximately ninety degrees from the first pins 48, where they engage and snap over stop blocks 46 as cap 10 reaches the closed position. The closed position however is accomplished when ceiling 24 abuts top rim 30, and beveled cap seal 36 abuts container neck seal 32, and in this case, the audible click of pins 48 is provided to indicate to the user that cap 10 is now in the closed position and further rotation of cap 10 is not required. This also helps prevent damage to cap 10 by excessive torquing.

During first initial assembly of cap 10 onto container neck 12 which will normally be performed at the factory after the filling of the bottle, threads 50 and 52 are cooperatively engaged and cap 10 is rotated clockwise until the sloped outer surface of wedge shaped stop blocks 44 engage stop blocks 46. At this point, the sloped surface of stop blocks 44 engage the straight surface 54 of stop blocks 46, and moderate rotational pressure is used to force blocks 44 over stop blocks 46. The inherent flexibility and resiliency in the plastic used to mold cap 10 also helps this initial passage of wedge shaped stop blocks 44 over the square or rectangular blocks 46. Once block 44 is forced completely over block 46, the exterior wall 18 returns to a relaxed position, and reverse or counter clockwise rotation of cap 10 causes abutment of the flat face of block 44 against the flat vertical edge 54 of block 46 which will stop any further rotation and thus removal of cap 10. Although extreme counter clockwise rotational force can be used to remove cap 10 once it has been assembled onto container neck 12, normal rotational pressure typically used by the user will not defeat the locking system of the stop blocks 44 and 46. This abutment of stop blocks 44 against stop blocks 46 is used both to prevent inadvertent removal of the cap 10 from container neck 12, and to indicate when the dispensing canal 41 is open.

By rotating cap 10 clockwise approximately a quarter turn, the closed position is accomplished which is indicated by an audible click and perceptible vibration when pins 48 ride over stop blocks 46. The riding of pins 48 over stop blocks 46 causes outward flexing of the bottom edge of exterior wall 18 when the pins 48 are on the high spot of the blocks 46, followed by the pins 48 moving beyond the high spot of the blocks 46 and the exterior wall 18 quickly returning to a relaxed state which causes a "click" and vibration. As previously stated, the closed positioned is accomplished by abutment of the various seals and not abutment of blocks 44 and blocks 46. In this closed position, container neck 12 is positioned within container neck housing 26 with top rim 30 abutted against ceiling 24 or the V-shaped seal ring 28 if used. Both seals 32 and 36 are also abutted, which places the upper edge of container neck 12 between dispensing aperture 40 and dispensing notch 38, thereby securely closing dispensing canal 41. Since the upper edge of container neck 12 is securely frictionally inserted into container neck housing 26, cap 10 will not rotate unless manually operated.

To open dispensing canal 41, cap 10 is rotated counter clockwise which raises cap 10 upward relative to neck 12 and bottle 13. When cap 10 reaches the open position, stop blocks 46 again abut shortly after snap pins 48 have snapped over the straight edges 54 of the blocks 46, creating another audible click and perceptible vibration. Simultaneously or right after the "click" has been made, blocks 46 abut stop blocks 44 and cease further rotation of cap 10, thereby indicating to the user that dispensing canal 41 is now in the fully open position. Cap 10 has now been raised sufficiently to expose dispensing aperture 40 and a portion of dispensing notch 38 above top rim 30, thereby creating an open dispensing canal 41. The contents of bottle 13 can now be dispensed through the interior of container neck 12 to ceiling 24. The angle of ceiling 24 directs the contents of bottle 13 towards the open dispensing canal 41, and provides less flow resistance than would a flat ceiling with right angled corners. The contents are then directed into dispensing canal 41 which includes dispensing notch 38, a portion of top rim 30 and dispensing aperture 40. Any excess contents of bottle 13 can afterward be easily wiped out of concave depression 42 with one finger, and due to the size and shape of depression 42, and of the very shallow dispensing aperture 40 and the thin plastic defining aperture 40, when the aperture 40 is wiped, contact may be made with the wipe against the exterior surface of the portion of the container neck 12, and thus essentially no product would be left in the dispensing aperture 40 to cause clogging or to culture bacteria.

The audible clicks which are preferably accompanied with perceptible vibration could be clicks alone or vibration alone, but it is desired to give the user an indication of a full open or full closed dispensing canal 41, other than the rotatable cap 10 just becoming hard to rotate. The indicators of the present invention of a full open or full closed dispensing canal, which the user can sense with one or more of his five human senses needs to be other than the senses of smell, taste or sight in my opinion, and therefor since the user's hands are on the closure, vibration would be a suitable means to communicate information relative to the dispensing canal 41, and an audible click in combination with the vibration would also be desirable as a further verifier. Sight indicators such as arrows could also additionally be used, but are less feasible since the user must consciously look at the arrows.

The exterior top surface of top panel 16 which is considered the top of cap 10 is effectively flat, and preferably slightly concaved at 56 which provides an annular level surface edge for the inverted storage of the assembled bottle 13 and cap 10. By creating a slightly concave surface instead of a flat surface, the irregularities which can often occur in molding a flat surface which would imbalance bottle 13 are avoided. By enabling the inverted storage of bottle 13, gravity draws the last portions of the contents of bottle 13 towards cap 10 where it can be easily dispensed when next used without the user repeatedly banging the top end of bottle 13 against his palm.

Although I have very specifically described the preferred structures of the invention, it should be understood that the specific details are just that, "preferred" structures given for example to those skilled in the art. Many minor changes in the specific structures described may obviously be made without departing from the scope of the invention, and therefore it should be understood that the scope of the invention is not to be limited by the specification and drawings given for example, but is to be determined by the spirit and scope of the appended claims.

What I claim as my invention:

1. A closure for a container, comprising in combination;

a cap having an annular exterior wall and a smaller diameter annular interior wall placed concentric to and in spaced relationship with said exterior wall, the cap walls depending from a cap top defining a closed top end of said cap, the cap walls extending from said cap top toward an opened bottom end of said cap oppositely disposed from said closed top end, said exterior wall extending further than said interior wall, said interior wall terminating at a bottom end thereof in an angled plane seal component, said cap top having an outer surface oppositely disposed from said interior wall with said outer surface of said cap top structured for providing stability to said cap when inverted and resting on said outer surface of said cap top so as to be able to support an inverted container connected to said cap, said interior surface of said exterior wall having affixed threading approximately positioned in elevation between said opened bottom end of said cap and the terminal bottom end of said interior wall, a dispensing notch transversely through said interior wall with said dispensing notch extending and opening through the terminal bottom end of said interior wall, a dispensing opening through said exterior wall and aligned with said dispensing notch to define a dispensing canal, said dispensing opening positioned at an approximately juncture between said cap top and said exterior wall of said cap, a depression around said dispensing opening, said depression positioned in said exterior wall and extending into said cap top adjacent said exterior wall, said dispensing opening positioned within said depression, said cap placed upon a generally cylindrical hollow neck attached to a container with said neck sized to fit within said cap, an exterior surface of said neck affixed with threads engaged with said threading of said cap and arranged so that rotation of said cap on said neck in a first direction causes rising of said cap relative to said neck, and rotation of said cap on said neck in a second direction causes lowing of said cap relative to said neck, an interior of said container neck having at least two diameters with the two diameters including an upper neck portion being a substantially thinned portion tightly and sealingly yet movably fitted between said exterior and interior walls of said cap with said interior wall of said cap positioned within said neck, a narrow top rim of said upper neck portion sealingly abutted against an underside portion of said cap top, the thinned upper portion of said neck positioned between said dispensing notch and said dispensing opening and blocking said dispensing canal, said angled plane seal component at the bottom end of said interior wall sealingly abutted against a cooperatively structured angled plane seal within said neck defined by a transition between said at least two diameters in the interior of said container neck, said threading of said cap and said threads of said neck arranged to allow sufficient cap rising so as to allow sufficient withdrawal of the thinned upper portion of said neck to clear said dispensing notch and said dispensing opening and thus open said dispensing canal with said interior wall of said cap remaining at least in part within said neck.

2. A closure for a container, comprising in combination;

a cap having an annular exterior wall and a smaller diameter annular interior wall placed concentric to and in spaced relationship with said exterior wall, the cap walls depending from a cap top defining a closed top end of said cap, the cap walls extending from said cap top toward an opened bottom end of said cap oppositely disposed from said closed top end, said exterior wall extending further than said interior wall, said interior wall terminating at a bottom end thereof in an angled plane seal component, said cap top having an outer surface oppositely disposed from said interior wall with said outer surface of said cap top structured for providing stability to said cap when inverted and resting on said outer surface of said cap top so as to be able to support an inverted container connected to said cap, at least one stop block affixed on an interior surface of said exterior wall adjacent said opened bottom end of said cap, said interior surface of said exterior wall having affixed threading approximately positioned in elevation between said stop block of said cap and the terminal bottom end of said interior wall, a dispensing notch transversely through said interior wall with said dispensing notch extending and opening through the terminal bottom end of said interior wall, a dispensing opening through said exterior wall and aligned with said dispensing notch to define a dispensing canal, said dispensing opening positioned at an approximate juncture between said cap top and said exterior wall of said cap, a depression around said dispensing opening, said depression positioned in said exterior wall and extending into said cap top adjacent said exterior wall, said dispensing opening positioned within said depression, at least one annular seal ring depending from said cap top between said exterior and interior walls;

said cap placed upon a generally cylindrical hollow neck attached to a container with said neck sized to fit within said cap, an exterior surface of said neck affixed with threads engaged with said threading of said cap and arranged so that rotation of said cap on said neck in a first direction causes rising of said cap relative to said neck, and rotation of said cap on said neck in a second direction causes lowing of said cap relative to said neck, an interior of said container neck having at least two diameters with the two diameters including an upper neck portion being a substantially thinned portion tightly and sealingly yet movably fitted between said exterior and interior walls of said cap with said interior wall of said cap positioned within said neck, a narrow top rim of said upper neck portion sealingly abutted against said annular seal ring of said cap top, the thinned upper portion of said neck positioned between said dispensing notch and said dispensing opening and blocking said dispensing canal, said angled plane seal component at the bottom end of said interior wall sealingly abutted against a cooperatively structured angled plane seal within said neck defined by a transition between said at least two diameters in the interior of said container neck, at least one stop block on said exterior surface of said neck, said stop block of said neck positioned relative to said stop block of said cap so as to limit rising during rotation of said cap relative to said neck, the stop blocks arranged to allow sufficient cap rising so as to allow sufficient withdrawal of the thinned upper portion of said neck to clear said dispensing notch and said dispensing opening and thus open said dispensing canal with said interior wall of said cap remaining at least in part within said neck, open indicating means for indicating an open dispensing canal, said open indicating means including cooperative structures attached to said cap and said neck which are positioned engagable with one another approximate the full opening of said dispensing canal wherein engagement of said cooperative structures triggers a snapping resulting in perceptible signaling to at least one human sense, close indicating means for indicating a closed dispensing canal, said close indicating means including cooperative structures attached to said cap and said neck which are positioned engagable with one another approximate the full closing of said dispensing canal wherein engagement of said cooperative structures triggers a snapping resulting in perceptible signaling to at least one human sense.

* * * * *